US005579608A

United States Patent [19]

Dunn

[11] Patent Number: 5,579,608

[45] Date of Patent: Dec. 3, 1996

[54] GATE FOR A CAR PORT ADJACENT A MOBILE HOME

[76] Inventor: Lee G. Dunn, 2330-255 E. Ave. J8, Lancaster, Calif. 93535

[21] Appl. No.: 355,498

[22] Filed: Dec. 14, 1994

[51] Int. Cl.[6] ..... E05D 15/06

[52] U.S. Cl. ..... 49/404; 256/73

[58] Field of Search ..... 49/404; 256/26, 256/73

[56] References Cited

U.S. PATENT DOCUMENTS

| | | | |
|---|---|---|---|
| 4,188,057 | 2/1980 | Pauli | 296/162 |
| 4,413,855 | 11/1983 | Flanagan | 296/162 |
| 4,474,403 | 10/1984 | Miller | 296/96 |
| 4,916,860 | 9/1990 | Richmond et al. | 49/28 |
| 4,941,284 | 7/1990 | Stoller | 49/49 |
| 5,012,612 | 5/1991 | Kille | 49/254 |
| 5,097,790 | 3/1992 | Massey | 116/303 X |
| 5,125,202 | 6/1992 | Kissinger | 49/404 X |
| 5,170,746 | 12/1992 | Roose | 256/73 X |

FOREIGN PATENT DOCUMENTS

| | | | |
|---|---|---|---|
| 333981 | 9/1989 | European Pat. Off. | 49/404 |
| 1559205 | 9/1969 | Germany | 49/404 |
| 745694 | 2/1958 | United Kingdom | 49/404 |

*Primary Examiner*—Jerry Redman
*Attorney, Agent, or Firm*—Noram B. Rainer

[57] ABSTRACT

A gate assembly for use on a mobile home having an adjacent driveway and a carport roof includes a gate and associated components to facilitate sliding movement and securement of the gate between the mobile home and a vertical post that supports the roof. The rear face of the gate has a horizontally disposed track. The bottom of the gate has a wheel adapted to roll in a vertical plane upon the driveway. The associated components include rail members adapted to be mounted to the mobile home and post to receive the track on the gate and thereby support the gate.

6 Claims, 2 Drawing Sheets

GATE FOR A CAR PORT ADJACENT A MOBILE HOME

BACKGROUND OF THE INVENTION

1. Field of the Invention

This invention concerns a gate, and more particularly relates to a sliding gate adapted to extend laterally across a car port associated with a mobile home.

2. Description of the Prior Art

Mobile homes often are parked for long durations at a particular site where improvements are made to the site adjacent the mobile home to provide a more comfortable lifestyle. One such improvement is a car port which may be comprised of a paved driveway and an overhead protective roof or canopy.

In order to obtain a measure of privacy and security comparable to that provided by automobile garages associated with residential buildings, it is desirable to have a door or equivalent closure device interactive with the car port of the mobile home. A door for closing a garage or car port must of necessity be a large structure. Most doors for residential garages involve laterally segmented doors which roll upwardly upon a track mechanism supported by the roof or sidewalls of the garage.

In the case of carports associated with mobile homes, there is inadequate roof or wall structure for supporting a garage-type door of conventional design.

Accordingly, it is an object of the present invention to provide a closure device for a carport associated with a mobile home.

It is another object of this invention to provide a closure device as in the foregoing object in the form of a gate that cam be structurally supported by the mobile home.

These and other beneficial objects and advantages will be apparent from the following description.

SUMMARY OF THE INVENTION

The above and other beneficial objects and advantages are accomplished in accordance with the present invention by an assembly or kit of components for providing a sliding gate for traverse upon a driveway between the flat front wall of a mobile home and a vertical support post for a carport roof disposed above said driveway, said assembly comprising:

a) a gate comprising:
   1) a rectangular frame comprised of horizontal top and bottom elongated rigid beams having front and rear flat surfaces and proximal and distal lateral extremities, and paired upright beams which dispose said horizontal beams in vertically spaced coplanar juxtaposition, said distal extremities defining the leading end of the gate, and said proximal extremities defining the trailing end of the gate,
   2) opaque face panels disposed upon the front surfaces of said horizontal beams and elongated vertically threbetween, said panels having front and rear surfaces,
   3) first sliding support; means horizontally secured to said frame in association with the rear surfaces of said panels, and
   4) a wheel affixed to said bottom beam adjacent the distal extremity thereof and adapted to rotate in a vertical plane upon said driveway, thereby permitting movement of said gate from a storage state to a deployed state extending between said post and mobile home, b) second sliding support means adapted to be mounted upon the flat front wall of said mobile home and configured to slidably receive said first sliding support means in said storage state, c) third sliding support means adapted to be mounted upon said post and configured to slidably receive a portion of said first sliding support means adjacent the leading end of the gate, thereby aligning the gate in its deployed state, and d) latching means adapted to be mounted upon said post and adapted to releasibly secure the leading end of the gate.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
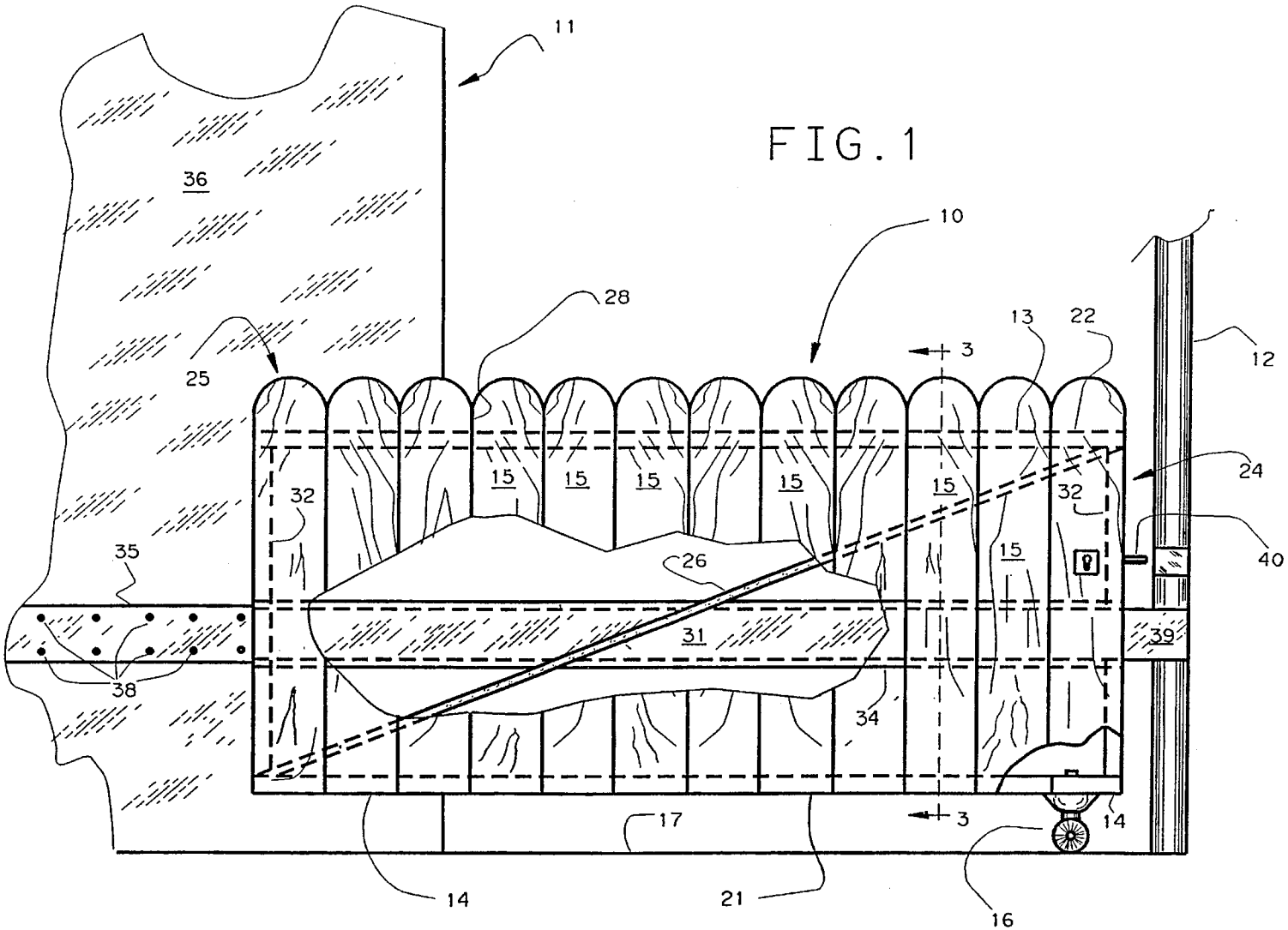
FIG. 1 is a front view with portions broken away showing an embodiment of the sliding gate assembly of the present invention in functional relationship with a mobile home and associated car port roof support port.
Figure 2:
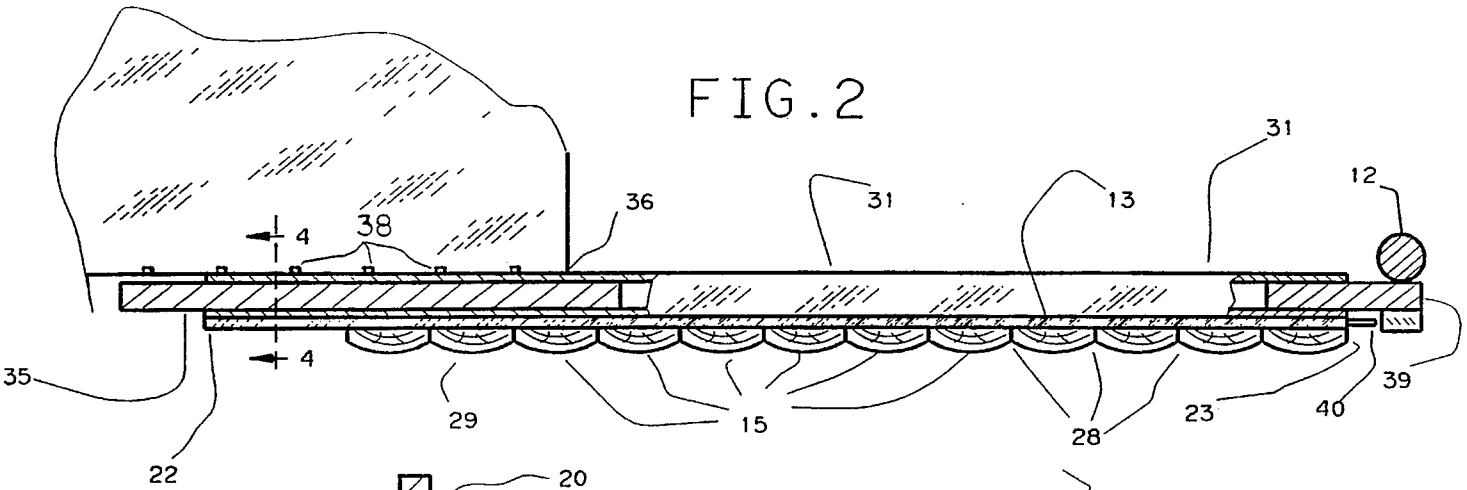
FIG. 2 is a top view of the embodiment of FIG. 1 with portions broken away to reveal interior details.
Figure 4:
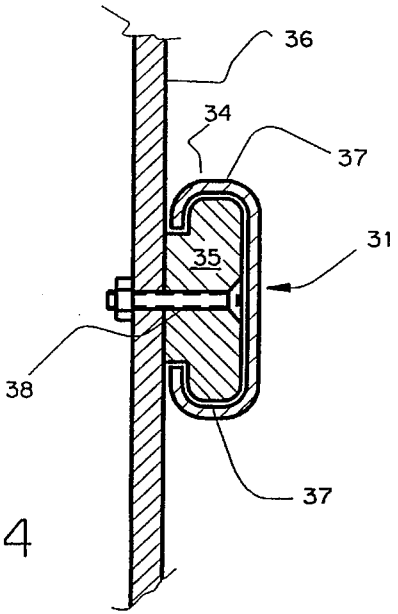
FIG. 4 is an enlarged sectional view taken in the direction of the arrows upon the line 4—4 of FIG. 2.
Figure 3:
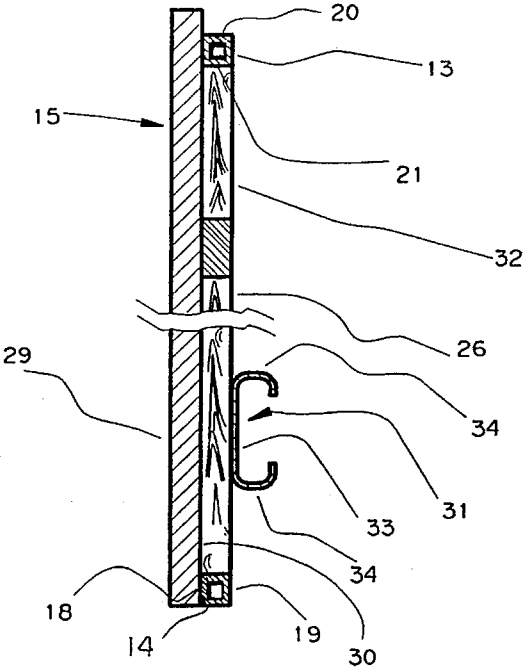
FIG. 3 is an enlarged sectional view taken in the direction of the arrows upon line 3—3 of FIG. 1.

Referring to FIGS. 1–4, an embodiment of the sliding gate 10 of the present invention is shown in its deployed state, extending between mobile home 11 and the vertical support post 12 of a conventional carport roof, now shown.

Gate 10 is comprised in general of a rectangular frame 42 and a multitude of face panels 15 disposed upon said frame. A wheel 16 downwardly directed from said frame is adapted to rotate in a vertical plane upon driveway 17 associated with said carport.

Frame 42 is comprised of horizontal beams 13 and 14, preferably of rectangular tubular construction, having front, rear, upper and. lower flat surfaces, 18, 19, 20 and 21, respectively, and proximal and distal lateral extremities 22 and 23, respectively. Said beams are held by paired upright beams 32 in vertically spaced coplanar ,juxtaposition, whereby said distal extremities define the leading end 24 of the gate, and said proximal extremities define the trailing end 25 of the gate.

A diagonal bracing strut 26 extends between a distal extremity of one beam and the proximal extremity of the other beam. The purpose of strut 26 is to impart strength and stability to the gate. In alternative embodiments, other equivalent bracing means may be utilized to achieve the same effect.

A wheel 16 is disposed upon lower flat surface 21 of bottom beam 14 adjacent the distal extremity thereof. Said wheel is adapted to rotate in a vertical plane upon driveway 17, thereby permitting lateral movement of the gate from a storage state wherein it rests upon the mobile home, to a deployed state, as shown in the drawings, where the gate extends between the mobile home and post 12.

Visual barrier means in the form of opaque face panels 15 are vertically elongated between said horizontal beams and attached thereto. The panels are characterized in having interlocking side edges 28 and front and rear surfaces 29 and 30, respectively. Alternative equivalent visual barrier means may be utilized for achieving the same effect in providing a neat appearing privacy barrier. The face panels further serve as a deterrent toward unauthorized entry of persons into the carport, and mitigate entrance of wind-driven rain, snow and dust.

A first sliding support means in the form of C-shaped channel 31 is attached in horizontal disposition to the coplanar rear surfaces of upright beams 32 and diagonal strut 26. As shown more clearly in FIG. 3, the exemplified sliding support means is an extruded form track comprised of base panel 33 and opposed facing retaining lips 34.

A second sliding support means, exemplified as rail 35 having an extruded form is mounted upon flat end wall 36 of mobile home 11. As shown more clearly in FIG. 4, rail 35 is configured so as to have holding edges 37 which slidably receive the retaining lips 34 of channel 31. Rail 35 is secured to wall 36 by way of bolts 38 recessed into said rail. The length of rail 35 is such as to accommodate the entire length of the gate when the gate is in its open or storage state.

A third sliding support means in the form of rail 39, having the same cross-sectional configuration of rail 35, is affixed to post 12, its purpose being to supportively align the leading edge of the gate in the deployed state. In said function, rail 39 slidably receive a portion of channel 31. In alternative embodiments of the invention, channel 31 may instead be a rail or other insertive or receiving configuration, and rails 35 and 39 may instead be channels or other embracing configuration. Other configurations of sliding support means are also contemplated, such as T-shape, and still other designs.

The length of the gate is larger than the distance between post 12 and mobile home 11, said length being such as to permit at least one foot of length of interengagement of said first and second sliding support means when the gate is in its deployed state, namely interactive with post 12.

Latching means 40 are interactively associated with post 12 and the upright beam 32 at the leading end of the gate. The function of said latching means is to enable the gate to be locked in its deployed state. The various components of the gate may be of wood, metal or plastic configuration.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An assembly for providing a sliding gate for traverse upon a driveway between a flat front wall of a mobile home and a vertical support post, said assembly comprising:

a) a gate comprising:

1) a rectangular frame comprised of horizontal top and bottom elongated rigid beams having front and rear flat surfaces and proximal and distal lateral extremities, and paired upright beams which dispose said horizontal beams in vertically spaced coplanar juxtaposition, said distal extremities defining a leading end of the gate, and said proximal extremities defining a trailing end of the gate, 2) opaque face panels disposed upon the front surfaces of said horizontal beams and elongated vertically therebetween, said panels having front and rear surfaces, 3) first sliding support means horizontally secured to said frame in association with the rear surfaces of said panels, and 4) a wheel affixed to said bottom beam adjacent the distal extremity thereof and adapted to rotate in a vertical plane upon said driveway, thereby permitting movement of said gate from a storage state to a deployed state extending between said post and mobile home, b) second sliding support means mounted upon said flat front wall and configured to slidably receive said first sliding support means in said storage state, c) third sliding support means mounted upon said post and configured to slidably receive a portion of said first sliding support means adjacent said leading end, thereby aligning the gate in its deployed state, and d) latching means mounted upon said post and adapted to releasibly secure said leading end.

2. The assembly of claim 1 wherein said beams are of rectangular tubular configuration.

3. The assembly of claim 1 wherein the length of said gate is such that at least one foot of length of said gate remains engaged with said second sliding support means mounted on said mobile home when said gate is in its deployed state.

4. The assembly of claim 1 wherein said second and third sliding support means are of identical cross-sectional configuration.

5. The assembly of claim 4 wherein said first sliding support means has an embracing configuration and said second and third sliding support means have a receiving configuration.

6. The assembly of claim 5 wherein said first sliding support means has a C-shaped cross sectional configuration.

* * * * *